US009945094B2

(12) United States Patent
Azzolin et al.

(10) Patent No.: US 9,945,094 B2
(45) Date of Patent: Apr. 17, 2018

(54) BUCKET FOR SCREENING AND CRUSHING INERT MATERIAL

(71) Applicant: MECCANICA BREGANZESE S.p.A. in breve MB S.p.A, Fara Vicentino (VI) (IT)

(72) Inventors: Guido Azzolin, Breganze (IT); Diego Azzolin, Breganze (IT)

(73) Assignee: MECCANICA BREGANZESE S.P.A. IN BREVE MB S.P.A., Fara Vicentino (VI) (IT)

( * ) Notice: Subject to any disclaimer, the term of this patent is extended or adjusted under 35 U.S.C. 154(b) by 124 days.

(21) Appl. No.: 14/348,620

(22) PCT Filed: Sep. 28, 2012

(86) PCT No.: PCT/IB2012/055189
§ 371 (c)(1),
(2) Date: Mar. 31, 2014

(87) PCT Pub. No.: WO2013/046167
PCT Pub. Date: Apr. 4, 2013

(65) Prior Publication Data

US 2014/0326816 A1 Nov. 6, 2014

(30) Foreign Application Priority Data

Sep. 30, 2011 (IT) ..... PD2011A0309

(51) Int. Cl.
*E02F 3/407* (2006.01)
*E02F 3/96* (2006.01)
(Continued)

(52) U.S. Cl.
CPC ..... *E02F 3/407* (2013.01); *B02C 1/02* (2013.01); *B02C 23/08* (2013.01); *B07B 1/15* (2013.01);
(Continued)

(58) Field of Classification Search
CPC .. E02F 3/407; E02F 3/965; E02F 7/06; B02C 23/08; B02C 1/02; B07B 1/15; B07B 1/16
USPC ..... 241/81, 101.1, 198.1, 222; 209/672
See application file for complete search history.

(56) References Cited

U.S. PATENT DOCUMENTS 1,136,674 A * 4/1915 Houston ..... B07B 1/16 209/396
1,941,147 A * 12/1933 Johlige ..... B07B 1/15 209/396

(Continued)

FOREIGN PATENT DOCUMENTS

| | | |
|---|---|---|
| JP | H021280 U | 1/1990 |
| WO | 2006105864 A1 | 10/2006 |
| WO | 2012028766 A1 | 3/2012 |

OTHER PUBLICATIONS

ISR and Written Opinion in PCT/IB2012/055189 dated May 8, 2013.

*Primary Examiner* — Shelley Self
*Assistant Examiner* — Gregory Swiatocha
(74) *Attorney, Agent, or Firm* — Kristina Castellano; Castellano PLLC

(57) ABSTRACT

A bucket for crushing inert material comprises an outer casing, an inlet section for the entry of the material to be crushed into the casing and crushing unit arranged in the casing for crushing the material and a screening device for screening the material to be crushed disposed in a position intermediate between the inlet aperture and the crushing unit. The screening device comprises at least one rotating member, the partial rotation of which is suitable for performing a screening of parts of material to be crushed which are of a size below a predetermined dimension.

7 Claims, 8 Drawing Sheets

(51) Int. Cl.

| | |
|---|---|
| ***B07B 1/15*** | (2006.01) |
| ***B07B 1/16*** | (2006.01) |
| ***E02F 7/06*** | (2006.01) |
| ***B02C 1/02*** | (2006.01) |
| ***B02C 23/08*** | (2006.01) |

(52) U.S. Cl.
CPC ..... *B07B 1/16* (2013.01); *E02F 3/965* (2013.01); *E02F 7/06* (2013.01)

(56) References Cited

U.S. PATENT DOCUMENTS

| | | | | | |
|---|---|---|---|---|---|
| 2,973,093 | A * | 2/1961 | Erickson | B07B 1/14 | 198/787 |
| 5,361,909 | A * | 11/1994 | Gemmer | B07B 1/005 | 209/12.1 |
| 5,799,801 | A * | 9/1998 | Clark | B07B 1/4636 | 209/261 |
| 5,887,810 | A * | 3/1999 | Maruyama | B02C 18/142 | 241/189.1 |
| 6,871,807 | B2 * | 3/2005 | Rossi, Jr. | B02C 13/09 | 241/101.72 |
| 7,007,877 | B1 * | 3/2006 | Kuhmonen | B07B 1/005 | 241/236 |
| 2004/0050986 | A1 * | 3/2004 | Rossi, Jr. | B02C 1/02 | 241/101.73 |
| 2005/0242220 | A1 * | 11/2005 | Azzolin | B02C 1/025 | 241/101.73 |
| 2013/0146691 | A1 * | 6/2013 | Malkamaki | B02C 18/144 | 241/24.1 |

* cited by examiner

BUCKET FOR SCREENING AND CRUSHING INERT MATERIAL

CLAIM FOR PRIORITY

This application is a U.S. National Stage Application of PCT/IB2012/055189 filed on Sep. 28, 2012, which claims priority to Italian application number PD 2011A000309 filed Sep. 30, 2011, the contents of both of which are incorporated herein by reference.

The present invention relates to a bucket for screening and crushing inert material of the type comprising the characteristics mentioned in the preamble of the main claim.

In the technical field being referred to, buckets are known, which can be applied to the end of the arm of an operating machine, and which comprise an outer casing, configured to collect inert material, such as rubble, material resulting from the demolition of buildings, inside which there are fitted means for crushing the collected material.

An example of this type of bucket is described in European patent EP 1532321, wherein the bucket exhibits a shovel body shape and the crushing means are implemented by a pair of jaws which acts on the material to be crushed with an alternating movement.

In such buckets, there is normally defined an aperture for the material to be crushed, inside which the material is inserted by making the bucket perform a collecting scoop function, by means of a suitable movement of the arm of the operating machine.

The pieces of material collected in this way will exhibit heterogeneous dimensions, with debris of large dimensions, which must undergo crushing, combined with rubble, sand and other objects of small dimensions which, on the other hand, can be used directly as reclaimed material.

It must be understood that the presence of such material of small dimensions mixed with the debris to be crushed in the crushing means not only limits the working capacity of the machine, by making the jaws act also on parts of already reclaimable material, but above all compromises the life and operation of the bucket.

In particular, the presence of sand is particularly damaging for the crushing means, both for its abrasive effect on their surfaces, and because the sand can penetrate into their mechanical components limiting their life.

In order to reduce the presence of material of small dimensions in the material to be crushed, screening baskets are used, which can be applied to the arm of the operating machine in a manner similar to the abovementioned buckets, such as for example as described in patent application EP 1 177 839.

The material thus screened will be discharged to the ground and then loaded into the crushing bucket. It is clear that this operation reduces the productivity of the system by requiring two separate working phases.

As an alternative to this solution, international patent application WO 2006/105864 proposes to also arrange on the casing, in addition to the crushing means, screening means at the inlet of the bucket.

The screening means are implemented by a perforated plate which forms the base of the inlet opening for the material to be crushed and onto which the material is laid down after having been collected. The plate is associated with a vibrating system for placing it in vibration and letting the material of small dimensions drop.

After this initial screening, the bucket is raised, letting the material fall into the crushing area in a manner that is conceptually analogous to the other known buckets.

This screening system however does not provide for obtaining a screening speed comparable with dedicated screening devices and, furthermore, requires a certain coordination between the collecting, screening and crushing phases, since an insufficient waiting time on the perforated plate does not produce an effective screening.

It must then be observed that, even if other screening systems placed on buckets are known, their use in combination with crushing systems turns out to the complex and in general not very effective.

For example, patent application EP 2 278 078 describes a bucket provided with a series of rollers for screening or crushing material.

The rollers support a series of star-shaped discs, or alternatively circular shaped discs, which are provided with a plurality of inserts along their edges, which when they rotate act on the material.

This solution, even though it can be adapted to screening material that is not too hard, does not lend itself to harder materials, such as those deriving from building demolitions, or inert materials of quarries and mines, which instead are typically crushed in the buckets illustrated above.

Indeed, specifically due to the lobes present in the star-shaped discs or, in an equivalent manner, due to the inserts present as an alternative to them, when the rollers rotate the material is free to creep into the spaces separating the rollers or between a roller and the casing of the bucket.

When these materials are too hard, the rotation of the roller is blocked, with a resulting interruption in the work. Consequently, this solution is not suitable for carrying out only one screening of the product as instead takes place in the vibrating-plate screening device described in patent application WO 2006/105864.

Therefore, the technical problem underlying the present invention is that of providing a bucket for screening and crushing inert material which enables the abovementioned drawbacks with reference to the prior art to be addressed.

This problem is solved by the bucket according to the present invention.

The present invention exhibits some significant advantages. The main advantage consists of the fact that the bucket according to the present invention is capable of performing a screening before crushing the material in a fast and effective manner, hence increasing the productivity of the system with respect to the known systems. In addition, it is capable of working even particularly hard materials without a risk of blockages of the screening system and resulting interruptions in the work cycle.

Other advantages, features and the modes of use of the present invention will become clear from the following detailed description of some embodiments, presented by way of example and in a non-limiting manner. Reference will be made to the figures of the appended drawings, in which.

Figure 1:
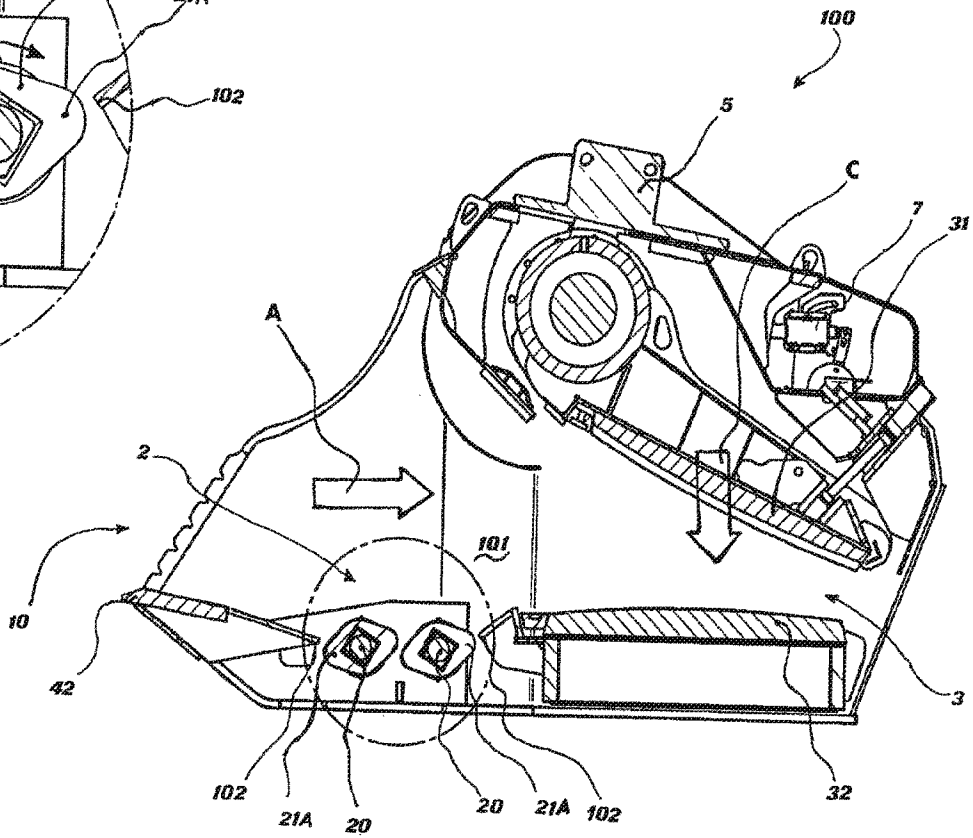
FIGS. 1 and 1A are a cross-sectional view from the side and an associated detail of a bucket according to the present invention.

With reference initially to FIG. 1, a bucket for crushing inert material, such as for example scrap material coming from building demolitions or excavations, is indicated in an overall manner by the reference number 100. Such a bucket is of the type suitable for being fitted to a movable arm of an operating machine, not illustrated in the drawings, by means of a connecting plate 5 or other equivalent attachment means.

The bucket 100 comprises an outer casing 1, inside which there is arranged a crushing unit 3, illustrated schematically.

The crushing unit 3 is disposed inside a feed channel 101 for the material to be crushed, along which a feed direction A is defined, substantially parallel to the direction of longitudinal development of the bucket.

Furthermore, according to a preferred embodiment, the crushing unit 3 is of the type with jaws, and comprises at least one movable jaw 31, preferably associated with a fixed jaw 32, which moves with alternating motion in a direction of crushing C perpendicular to the direction of feed A of the material. On the other hand, the movement of the jaw 31 can be combined, with one component in the direction C and one component parallel to the feed direction A.

It is also noted that in the present embodiment, the channel 101 exhibits a cross-section of substantially rectangular shape, so as to permit the movement of the jaw 31 inside it.

In the bucket 100 there is defined an inlet section 10 for the entry of the material to be crushed into the casing 1 and there is arranged a screening device 2 for screening the material to be crushed, disposed in a position intermediate between the inlet aperture 10 and the crushing unit 3. The casing additionally comprises a blade type appendage 42 disposed upstream of the screening device 2 with respect to the feed direction A, providing an improvement in the collecting of the material to be crushed from the ground, or more generally, from any working surface.

Figure 2:
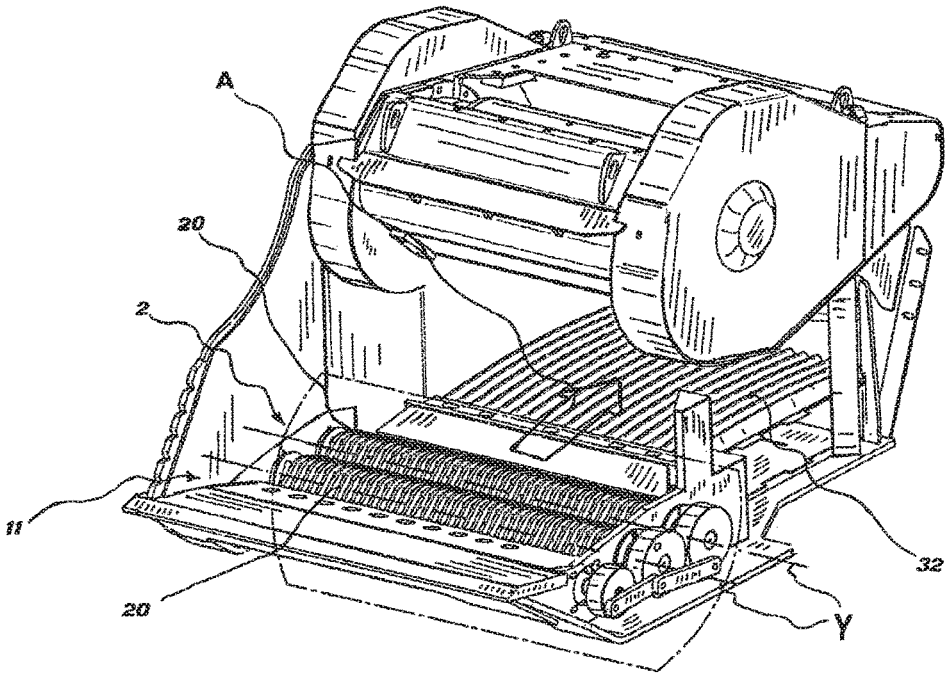
FIGS. 2 and 2A are a perspective view and an associated detail of the bucket of FIG. 1, in which some outer parts have been removed for the purposes of illustrating its internal component-makeup.
Figure 2A:
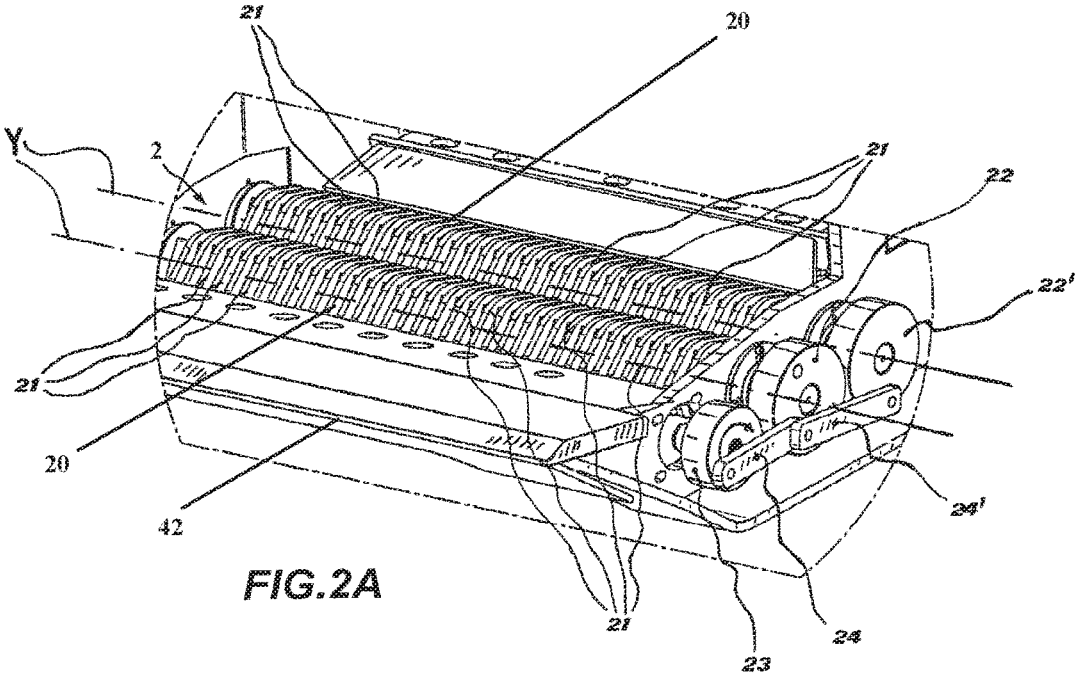
Figure 3:
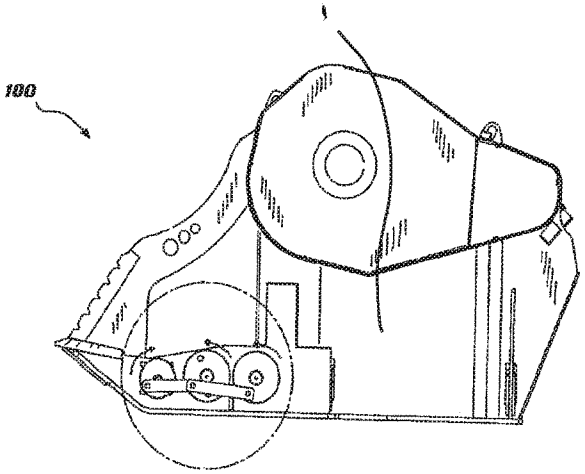
FIGS. 3 and 3A are a view from the front and an associated detail of a first variant embodiment of the bucket according to the present invention.
Figure 3A:
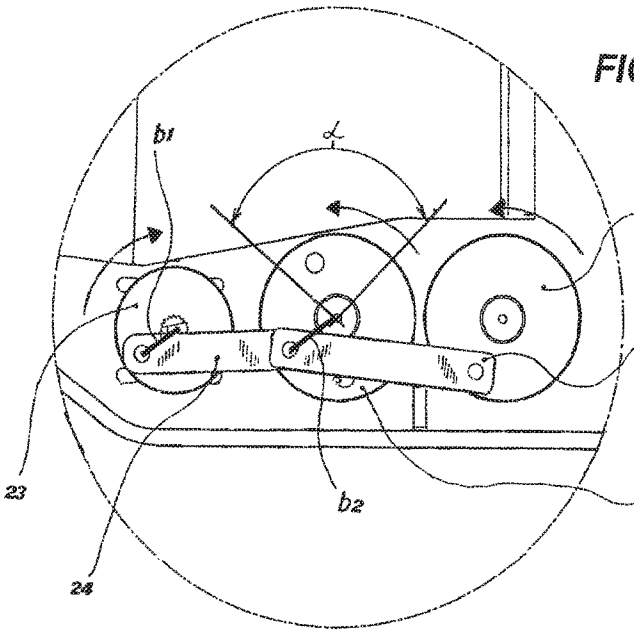
Figure 4:
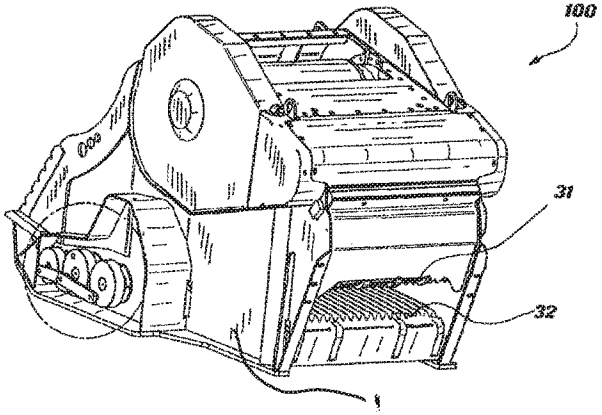
FIGS. 4 and 4A are a cross-sectional view from the side in detail and an associated detail of the bucket of FIG. 3.
Figure 4A:
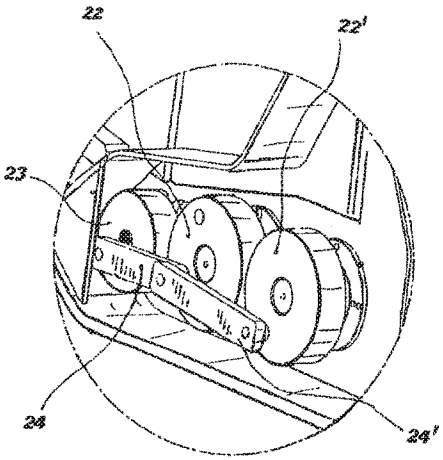
Figure 5:
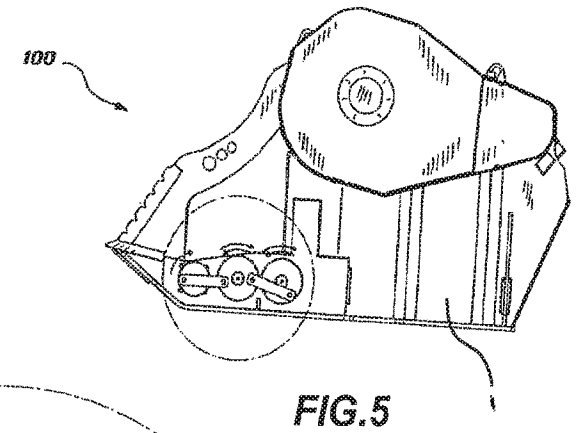
FIGS. 5 and 5A are a view from the side and an associated detail of a second variant embodiment of the bucket according to the present invention.
Figure 5A:
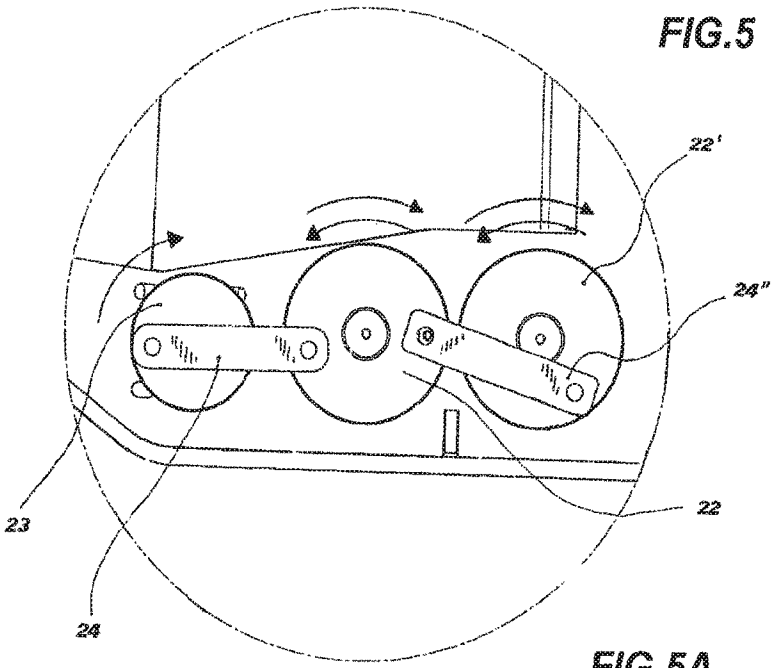
Figure 6:
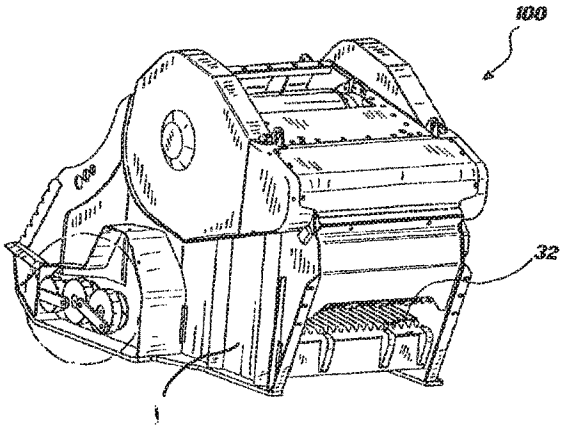
FIGS. 6 and 6A are a view from above and an associated detail of the bucket of FIG. 5.
Figure 6A:
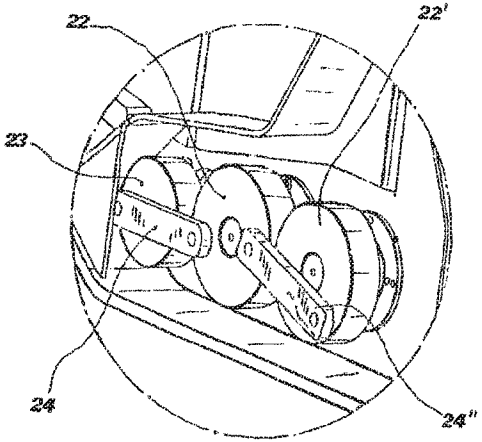
Figure 7:
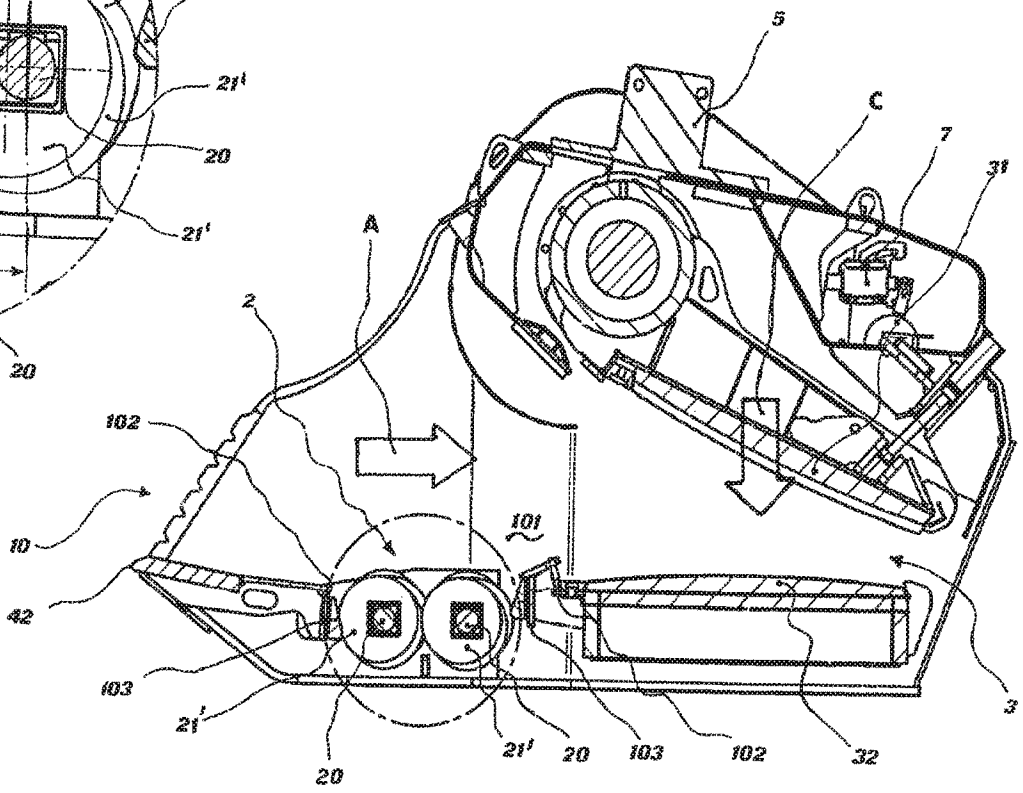
FIGS. 7 and 7A are a cross-sectional view from the side and an associated detail of the bucket of FIG. 5.
Figure 7A:
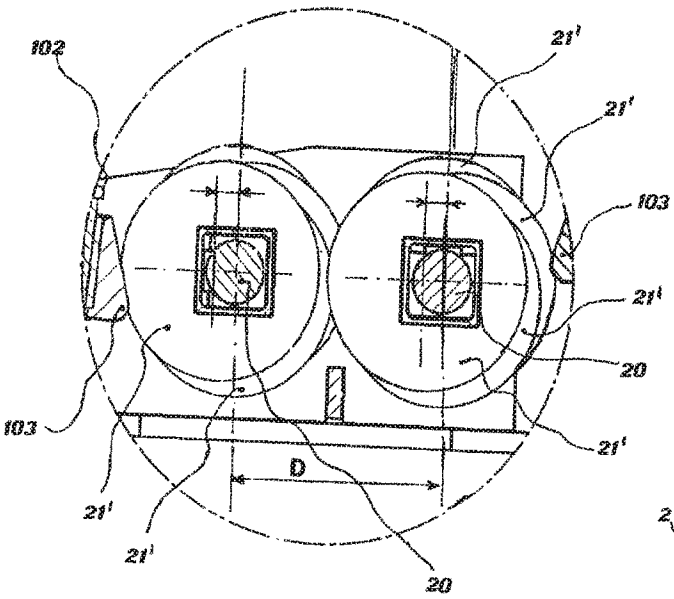
Figure 8:
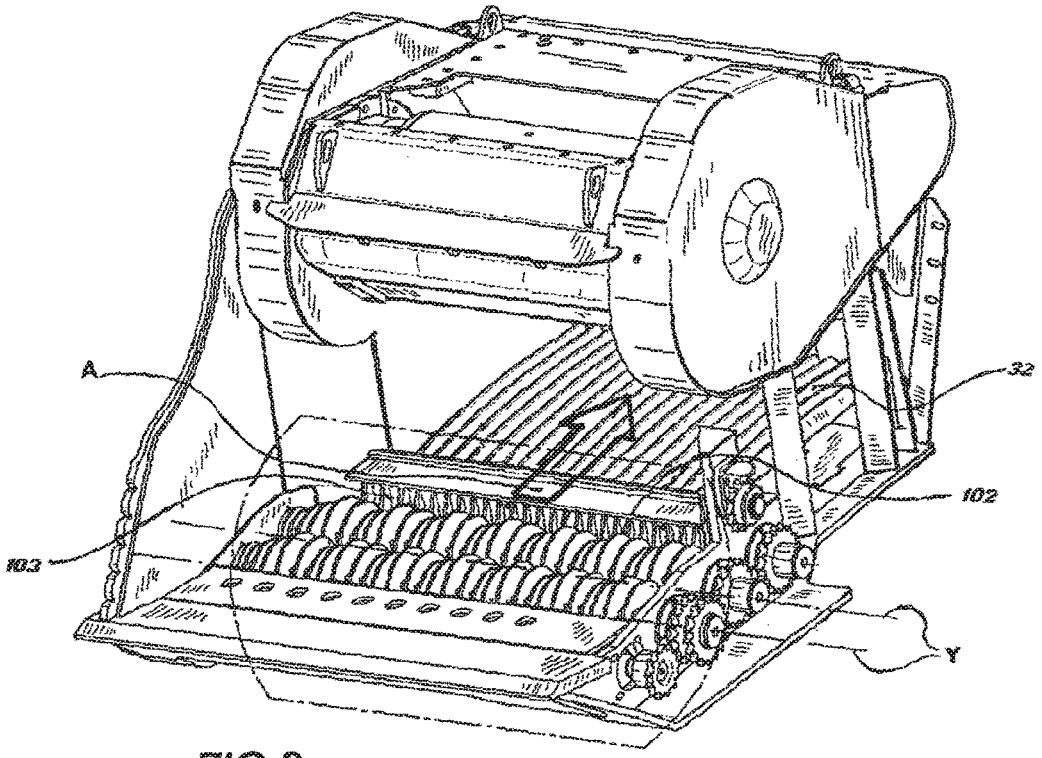
FIGS. 8 and 8A are a partial cross-sectional view from the front and an associated detail of the bucket of FIG. 5.
Figure 8A:
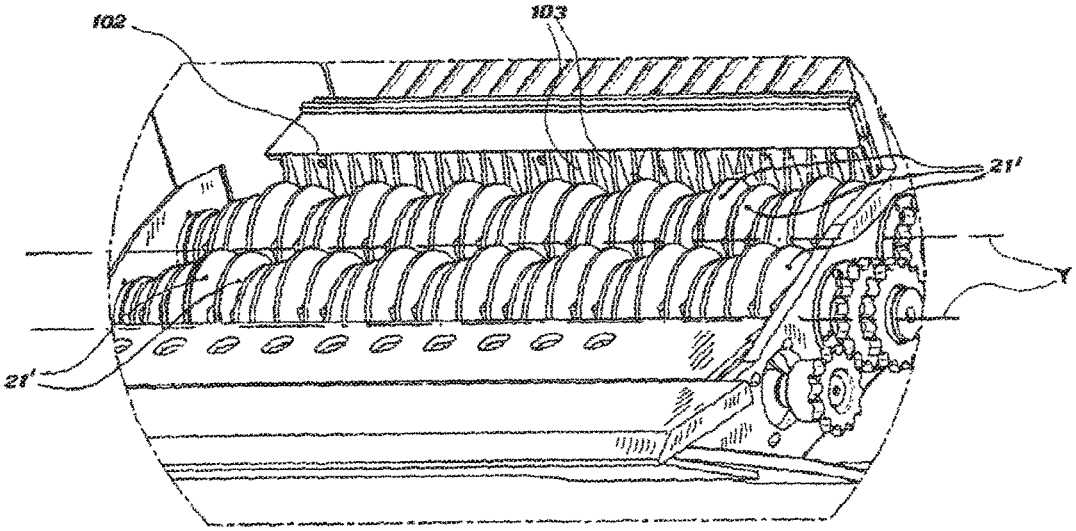

In more detail, the screening device 2 comprises at least one rotating member 20 rotatable about an axis Y substantially perpendicular to the feed direction A of the material towards the crushing unit 3, as illustrated in FIG. 2.

In more detail, the screening device 2 is formed by a pair of rotating members, rotatable in a concordant direction, and supported on the same casing 1, in a position adjacent to an inlet aperture 11 of the casing which, in the present embodiment, coincides with the inlet section 10.

Each rotating member 20 is in the shape of a shaft and supports a plurality of discs 21, which also have their axis parallel to the axis of rotation Y.

The rotating members are spaced out from one another and spaced out from respective edges of the base of the channel 101, these edges being adjacent to the rotating members, so as to define sufficient spaces for the passage of material which does not need to be crushed.

Figure 1A:
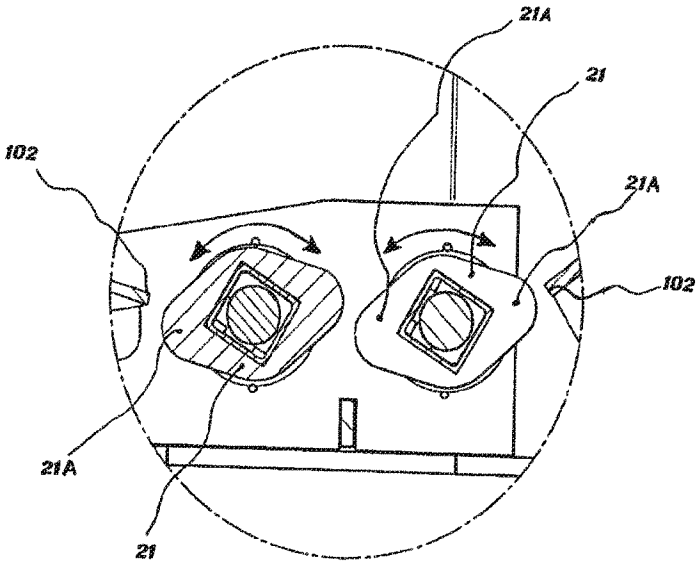

According to a first preferred embodiment, each disc 21 is provided with at least one pair of extensions 21A which are developed in a radial direction with diametrically opposite directions, as can be seen clearly in FIG. 1A. However, unlike the known systems, the rotating members 20 and, consequently, the extensions 21A do not perform a complete rotation, but are restricted to oscillate about the axis Y by an angle of rotation a of extent less than or equal to the angle between two consecutive extensions. This movement can be achieved by connecting a driving pulley 23 to a driven pulley 22, integral with the rotating member 20, by means of a connecting rod 24 hinged to both pulleys on opposite ends, thus defining an articulated quadrilateral thrust mechanism.

In more detail, by using an arm for the connecting rod 24 on the driving pulley 23 shorter than the arm on the driven pulley 22, one complete rotation of the driving pulley 23 will correspond to only a partial rotation of the pulley 22 and of the rotating member 20 integral with it. In other words, the distance b1 between the hinge point on the driving pulley 23 and the centre of rotation of the latter is less than the distance b2 between the hinge point on the driven pulley 22 and the axis Y.

The rotation motion is furthermore transmitted also to the pulley 22' using a further connecting rod 24' or other equivalent system for transmitting the motion. In any case, the use of the connecting rod 24' advantageously provides for transmitting a partial rotation mode to the pulley 22' similar to that of the driven pulley 22.

Of course, by modifying the arms of the connecting rod 24' on the pulleys 22 and 22', it will be possible to make the pulley 22' rotate by an angle having a magnitude that is different to the angle $\alpha$.

As can be observed also from FIG. 1A, providing an alternating rotation motion for the rotating members 20 of a magnitude less than a full circle, it will be possible to provide a movement on the material to be crushed so as to allow the passage between the two rotating members 20 or between one of these and the edges 102 of the bucket at the base of the channel 101 for the sandy parts and for the material that does not need to be crushed. Specifically, the material will be subject to an up-and-down movement, pushed by the extensions 21A and shuffled so as to achieve their screening. However, unlike the known systems, there will be no risk of material with dimensions larger than the spaces provided for the screening being subjected to the action of the extensions 21A, which extensions otherwise would be greatly stressed.

Indeed, by not carrying out a complete rotation but an oscillatory rotation motion, it will be possible to prevent the rotating members 20 from remaining blocked by the presence of material that is excessively hard and of large dimensions which creeps in between the rotating members or between the latter and the edges 102, since reversing the rotation moves the material away from the blocked position, bringing it back towards the centre of the channel 101.

By virtue of this feature, it is not in fact necessary to provide crushing capability for the rotating members 20, referring the crushing of the material to the crushing unit 3. This solution in fact succeeds in combining screening and crushing activities that are highly effective, ensuring at the same time a high productivity since the risk of blockage of the bucket is minimized.

It is also noted that the screening device according to the present invention provides, by virtue of the motion of the extensions 21A, for conferring an up-and-down motion on the material to be crushed, therefore obtaining an effective screening of it before it reaches the crushing unit.

In addition to the above-described features, another possibility can be provided of reversing the direction of rotation of the rotating members 20, by reversing the rotation of the driving pulley 23, in the event that material is blocked in the region of the spaces intended for the passage of the material.

This reversal of the rotation may take place either manually or automatically. In particular, if the rotating member 20 is placed in rotation by means of a hydraulic system, pressure sensors may be provided in the operating fluid supply circuit for the movement of the member 20 and the reversal of the rotation may take place if a predetermined pressure value is exceeded, indicating that the rotating member 20 is blocked.

In the case of hydraulic operation, the bucket according to the present invention can advantageously use the same circuit as that of the operating machine which is normally used to also operate the crushing unit 3.

For the purposes of reducing the maximum operating fluid capacity required to operate the system, means for selectively sending the oil capacity to the rotating member 20 or to the crushing unit 3 can be provided. Thus, with the same operating fluid capacity it will be possible to selectively operate the screening device 2 or the crushing unit 3, possibly providing a gradual shifting of the capacity between the device 2 and the unit 3. Thus, scenarios may be provided in which the screening device 2 continues, though with less intensity, the screening and pulverization action even while the crushing unit is operating.

Advantageously, means can also be provided for detecting the position 7 of the bucket, in particular for detecting its inclination, which means provide for identifying the position of the bucket and consequently operating the screening device 2 or the crushing unit, or operating both of them at reduced load.

FIGS. 5, 5A and 6, 6A represent a first variant embodiment of the present invention, which differs from the previous embodiment in that it exhibits rotating members 20 rotating in opposite directions. In other words, when a member 20 rotates clockwise, the other rotates anticlockwise, and vice versa.

This embodiment differs from the previous one in that it uses a connecting rod 24" hinged on the pinion 22' in different angular positions in comparison to the connecting rod 24'. In other words, the motion scheme which is thus used is that commonly defined as an articulated anti-parallelogram.

It is additionally noted that, for the purposes of reducing the screening spaces and of using extensions 21A of high radial extent, the discs 21 of each rotating member 20 can be offset with respect to the discs 21 of an adjacent rotating member 20, therefore providing an interpenetration of the trajectories of movement of the teeth 21A. Thus, it is possible to obtain a finer screening effect and smaller overall dimensions of the device.

According to another variant embodiment, represented in FIGS. 7, 7A and 8, 8A, each rotating member 20 comprises a plurality of discs 21' which are disposed eccentric with respect to the rotation axis Y of the rotating members 20 and offset with each other, i.e. the discs 21' on a rotating member exhibit geometric centres that are different from one another. Advantageously, as illustrated FIG. 7A, the discs 21' of each rotating member 20 exhibit the same eccentricity e of the corresponding discs 21' on the rotating member adjacent to it.

Consequently, by virtue of this configuration, the discs 21' of a rotating member 20 are kept during their rotation equidistant to the corresponding discs 21' of the other rotating member 20, therefore permitting a precise control of the material that is let through by the screening device. Thus, it will be possible, in a manner similar to the previous embodiments, to avoid material of excessive dimensions, and which as such would necessitate crushing, to be able to creep in between the rotating members 20.

In addition, the use of offset discs 21' along a respective rotating member 20, provides for imparting an up-and-down movement on the material being worked, thus optimizing the screening action, even in this case in a conceptually similar manner to the previous embodiments.

To further avoid the material from being able to block the rotating members of the screening device 2, at the edges 102, the bucket 100 is provided with a plurality of fins 103, which are developed between two adjacent discs 21', so as to limit the space useful for the passage of material. These fins 103 exhibit a substantially triangular shape and have a flat development substantially parallel to that of the discs 21'.

Unlike for the previous embodiment, the danger of blockage of the rotating members 20 is avoided even in the case of a complete rotation of the discs 21' since, because the extensions 21A are absent, the discs will not be subjected to stresses deriving from materials blocked in the screening device 2.

By therefore providing a complete rotation of the rotating members 20, it will be possible to achieve greater speeds with drive systems that are not very complex.

For example, the members 20 can be rotated by means of a belt or chain transmission, which receives its motion from the driving pulley 23.

It is further noted that in this last embodiment, the distance d between centres between the rotating members 20, understood as being the distance between the respective rotation axes, can be adjustable, so as to modify the size of the spaces defined for the passage of the material and, consequently, the characteristics of the screening.

Figure 9:
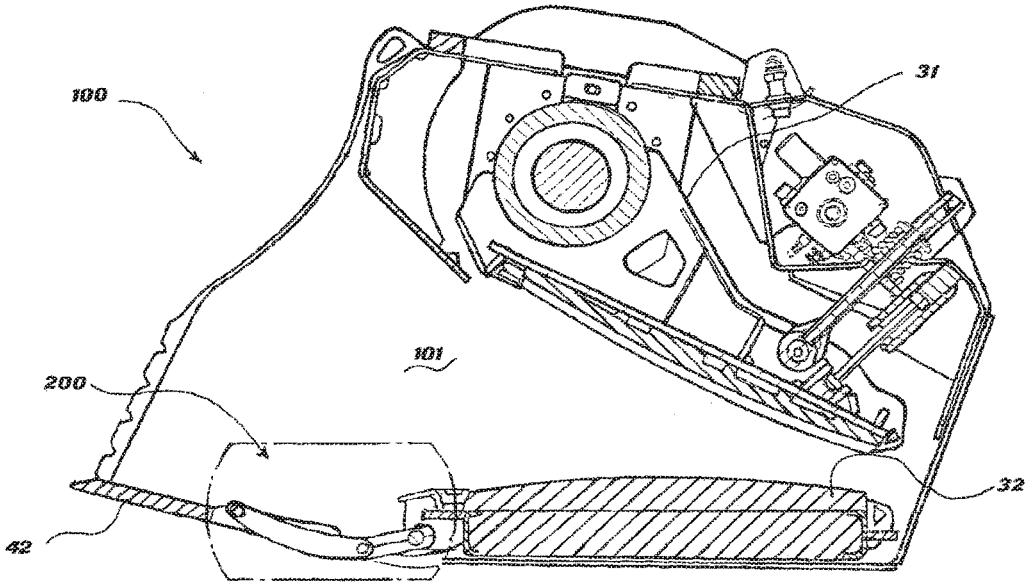
FIGS. 9 and 9A are a perspective view and an associated detail of the bucket of FIG. 5.
Figure 9A:
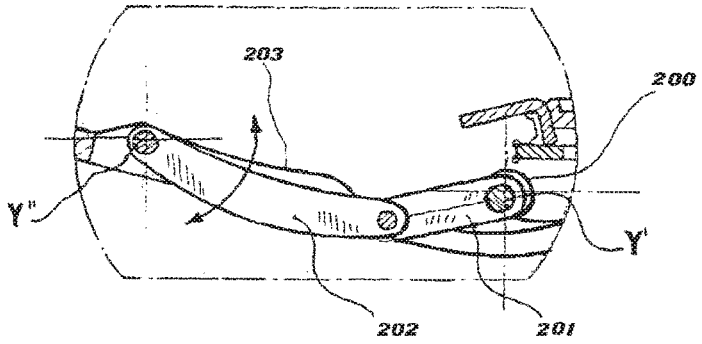
Figure 10:
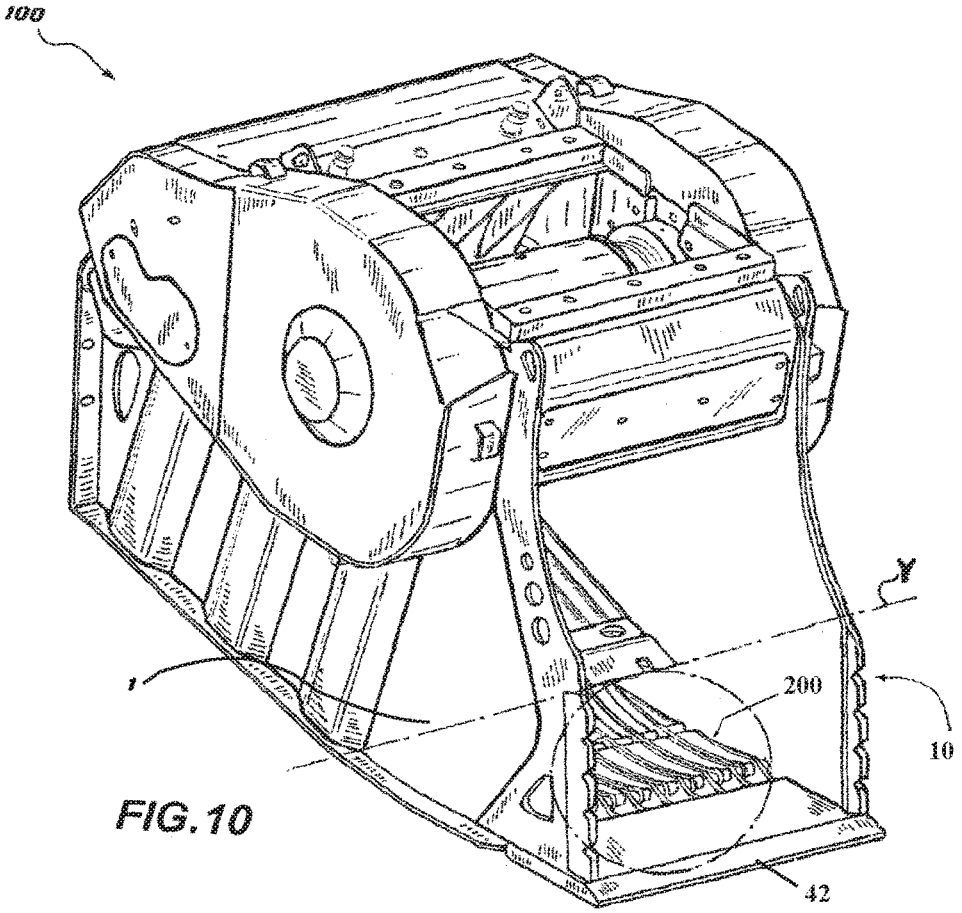
FIGS. 10 and 10A are a further perspective view and an associated detail of the bucket of FIG. 5, in which some outer parts have been removed for the purposes of illustrating its internal component-makeup.
Figure 10A:
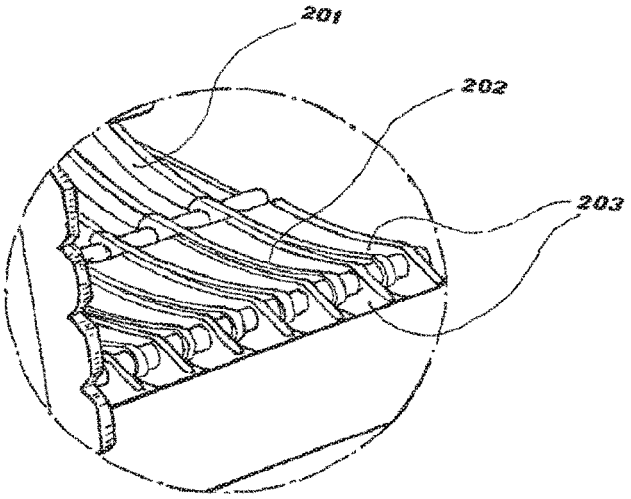

A fourth embodiment is represented in FIGS. 9 to 10A.

In this embodiment, the screening device comprises a rotating member 200 formed at a crankshaft rotatable at a rotation axis Y' substantially perpendicular to the feed direction A for feeding the material towards the crushing unit 3.

On the crankshaft, there are rotatably supported a plurality of pairs of connecting rods 201, 202 which, by means of the rotary movement about the axis Y', are subjected to an articulated quadrilateral movement.

Thus, the connecting rod 202, supported rotatably about an axis Y" parallel to the axis Y', oscillates about its rotation axis, penetrating with alternating motion into the channel 101.

This alternating movement hits the material to be crushed present in the channel 101, moving it and screening it.

In particular, as illustrated in FIG. 10A, the screening device also comprises a series of fixed ribs 203, parallel to the connecting rods 201 and 202 and placed between each pair of connecting rods, which provide for defining spaces for the passage of the material of a size below the predetermined dimension and which does not require crushing.

The invention therefore solves the stated problem, attaining a plurality of advantages at the same time, including a notable increase in the life of the crushing unit and of the screening device, in particular of the jaws and of the associated mechanical components, as well as lower maintenance requirements for the bucket.

The invention claimed is:

1. A bucket for screening and crushing inert material, comprising an outer casing, an inlet section for the entry of the material to be crushed into the outer casing, a crushing unit with jaws arranged inside the outer casing for crushing the material and comprising one fixed jaw and one movable jaw with alternating motion in a crushing direction perpendicular to a feed direction of the material in the outer casing and a screening device for screening the material to be crushed, disposed inside the outer casing in a position intermediate between the inlet section and the crushing unit and comprising at least two rotating members, aligned with the fixed jaw along the feed direction of the material in the outer casing, wherein the rotation of said at least two rotating members is suitable for carrying out screening of parts of material to be crushed which are of a size smaller than a predetermined dimension as defined by a space defined between the at least two rotating members, wherein each of said rotating members supports a plurality of discs having axes of rotation perpendicular to the feed direction of the material, wherein the discs are circular shaped and are disposed eccentric with respect to the rotation axis of one of the at least two rotating members and wherein adjacent discs of each of the at least two rotating members have a different eccentricity with respect to each other and the discs of one of the at least two rotating members exhibits the same eccentricity of a corresponding disc, aligned with respect to the feed direction, of an other one of the at least two rotating members adjacent thereto, trajectories of movement of the discs of the one of the at least two rotating members penetrating into trajectories of movement of the discs of the other one of the, adjacent, rotating member.

2. The bucket according to claim 1, wherein said at least two rotating members are supported inside the casing and wherein edges are defined on the outer casing in an area adjacent to the at least two rotating members, the bucket further comprising a plurality of fins which are developed between two adjacent discs of one of the at least two rotating members.

3. The bucket according to claim 2, wherein the fins exhibit a triangular shape and have a flat development parallel to that of the discs.

4. The bucket according to claim 1, wherein the at least two rotating members are parallel to one another.

5. The bucket according to claim 1, comprising an attachment for attachment to a free end of an arm of an operating machine such that the bucket can be moved by the arm of the operating machine.

6. A bucket according to claim 4, wherein said at least two rotating members have an adjustable distance between centres defined by their axes of rotation.

7. The bucket for screening and crushing inert material according to claim 1, wherein each disc of each of the at least two rotating members has a different eccentricity from the eccentricity of the disc or discs adjacent thereto.

* * * * *